United States Patent [19]

Jones et al.

[11] 4,260,157

[45] Apr. 7, 1981

[54] GOLF GAME EQUIPMENT

[76] Inventors: Elby W. Jones; Lawrence R. Phillips, both of 601 E. South Mountain Ave., D76, Phoenix, Ariz. 85040

[21] Appl. No.: 62,063

[22] Filed: Jul. 30, 1979

[51] Int. Cl.[3] ..... A63B 69/36; A63B 53/04; A63B 57/00

[52] U.S. Cl. ..... 273/177 R; 273/168; 273/162 E; 273/DIG. 8; 273/DIG. 5; 273/202; 273/207; 273/DIG. 20; 273/218; 273/199 R; 273/176 AB; 273/175

[58] Field of Search ..... 273/168, 167 A, 167 B, 273/177 R, 199 R, 207, 202, 162 E, 218, DIG. 8, DIG. 5, DIG. 20, 193 R, 175; 294/19 A

[56] References Cited

U.S. PATENT DOCUMENTS

| | | | |
|---|---|---|---|
| 1,510,302 | 9/1924 | Budrow | 273/207 |
| 2,213,190 | 9/1940 | Haverbach | 294/19 A |
| 2,712,939 | 7/1955 | Harp | 273/207 X |
| 3,086,779 | 4/1963 | Taylor | 273/177 R |
| 3,224,781 | 12/1965 | Hutchison | 273/168 X |
| 3,893,672 | 7/1975 | Schonher | 273/167 A |
| 4,150,826 | 4/1979 | Baldorossi et al. | 273/199 R X |

*Primary Examiner*—George J. Marlo
*Attorney, Agent, or Firm*—Gregory J. Nelson

[57] ABSTRACT

A golf game playable in an area of reduced size but closely simulating regulation golf using an enlarged ball having a scuff-resistant outer shell and a single dual faced golf club. The golf club has a head defining a first blade or ball striking surface which is curved or inclined to impart various degrees of loft to the ball depending on the location along the blade surface at which the ball is struck. The club head is provided with a second striking surface at the front edge of the first surface which is used for imparting a low, long distance trajectory to the ball as when driving the golf ball and which surface may also be used for putting the ball towards the target pin. The object is to advance the ball into a cup or specially designed target pin. The target pin includes a circular base ring which defines the target area and the base also supports an upstanding pin carrying an indicia bearing flag. A tee box is also provided having a cup for supporting the ball and an adjacent ramp for guiding the swing of the golfer to provide the proper impact location on the ball when driving the ball from the tee.

6 Claims, 14 Drawing Figures

GOLF GAME EQUIPMENT

The present invention relates to a game and more particularly relates to a variation of a conventional golf game.

Golf is a game which has captured the imagination and dedication of many men and women for years as a leisure time pursuit. Golf, conventionally, is played on a course having eighteen holes and typically ranging from about five to seven thousand yards in length. The game is played using a hard covered ball, which is governed by USGA standards and a selection of clubs not exceeding sixteen in number. The clubs are broadly divided into irons and woods and are variously weighted, pitched and designed to accomplish shots of varying distance and height. For example, a wood designated as a "driver" is often used from the tee box on longer holes. Various irons are used along the fairway and making approaches giving the required loft and distance. On the green, the ball is normally struck by a putter to propel the ball along the surface of the green towards the cup. Thus, the game of golf normally requires a substantial investment in clubs and equipment by the golfer.

In addition to the requirement for substantial equipment by the golfer, the investment in the establishment, construction and maintenance of a golf course is also substantial. A golf course of regulation length, often occupies at least one hundred twenty acres. With the rising real estate prices, taxes, maintenance costs, the provision of a golf course of regulation size often becomes prohibitive.

Beyond the above considerations, the game of golf requires considerable skill and time. On today's crowded courses, an eighteen hole match may take as long as six hours to play. Because of the skill level required, expensive equipment and investment in time, there obviously exists a need for a golf game which has the broad appeal in recreational aspects of conventional golf but which can be enjoyed by a larger segment of the population.

A number of substitutes for the regulation game of golf can be found in the prior art, but none have ever achieved great or widespread acceptance. For example, U.S. Pat. No. 4,026,561 relates to a substitute golf game which is designated in the patent as "soft golf".

In accordance with the present invention, I have proposed a new game which is played generally in the manner and style of regulation golf but on a course of reduced size. A ball is utilized which is somewhat larger than a conventional golf ball but generally gives the same characteristics when struck but travels a shorter distance. The ball is sized in proportion to preserve the "feel" which the golfer normally obtains when he swings a regulation golf club and strikes a regulation golf ball. Thus a golfer can play the game of the present invention on a course of reduced size.

The game of the present invention is played with a single dual faced golf club having a head which has an upper surface defining an inclined or arcuate striking surface provided with transverse grooves or ridges. The striking surface is used for playing elevated shots, the degree of loft being established by the point along the playing or striking surface at which the ball is hit. A putting and driving surface is provided at the leading edge of the club and is generally vertical. The putting and driving surface may be provided with an appropriate insert to which defines the "sweet spot". The ball is struck from an elevated tee at this surface when driving the ball. Similarly, when putting the surface is used to strike the ball toward the cup.

The target arrangement is defined by a cup of enlarged diameter or a target with a base having a circular rim which supports an upstanding flag. The diameter of the rim is substantially larger than the conventional cup in regulation golf. The object of the game is to move the ball from tee to cup using the single golf club of the present invention in as few strokes as possible.

It is therefore the main object of the present invention to provide a golf game which closely simulates regulation golf but is played on a course of reduced size.

It is another object of my invention to provide a novel and realistic golf game utilizing a ball which is somewhat larger than the conventional golf ball but gives the same feel of a regulation golf ball enabling the player to realize the full enjoyment of the game but on a shorter course.

It is another object of the present invention to provide a golf game which may be actively enjoyed by players of all ages and skill levels.

It is another object of the present invention to provide a golf game which requires less capital investment in golf course construction, maintenance and construction so the game can be adopted by municipalities, private clubs, institutions and the like at a substantially lower cost than is involved with the establishment of a conventional golf course.

It is still another object of the present invention to provide a unique golf club which can serve as a single club for striking the ball and providing a wide variety of shot trajectories and distances.

The above and other objects and advantages of the present invention will become more apparent from the following description, claims and drawings in which:

Figure 1:
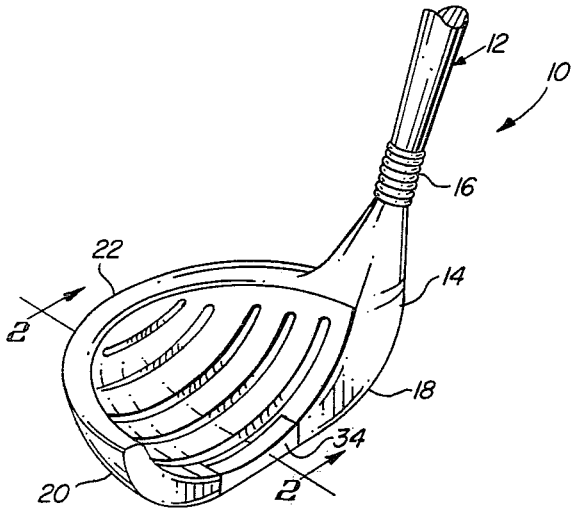
FIG. 1 is a perspective view of a golf club head according to the present invention.
Figure 2:
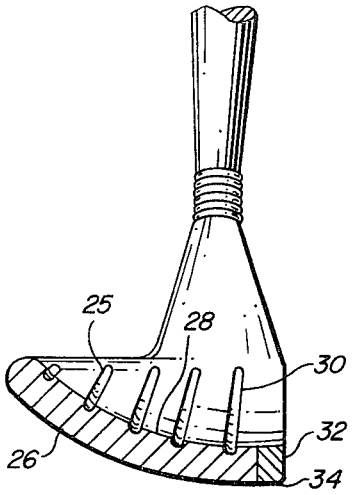
FIG. 2 is a sectional view taken along lines 2—2 of FIG. 1.

Turning now to the drawings, FIGS. 1 and 2 illustrate a golf club in accordance with the present invention. The golf club according to the present invention is generally designated by the numeral 10 and is mounted on a shaft 12 of conventional design terminating at the upper end at a grip, not shown. Club head 14 is attached to the lower end of shaft 12 at hosel 16. The golf club head has a heel 18 which is generally curved and an opposite curved toe portion 20. The heel and toe are configured to minimize the interference or striking ground. The rear edge 22 of the club is curved and as seen in top view, the rear edge of the club is generally semi-circular.

The bottom surface of the club is upwardly curved as best seen in FIG. 2 to minimize interference with the ground when the club is swung. A first ball striking surface termed the "Blade surface" 28, is formed in the club head and is generally concave from the heel portion to the toe portion of the club, in which direction for purposes of the present invention, will be designated the transverse axis of the club head. The blade surface is similarly curved from the front to rear, typically the radius of curvature in this direction will be approximately 3" to 4" with the center of the radius being forward of the club shaft. A plurality of transversely extending grooves 25 are provided at longitudinally spaced apart locations in the blade surface 28.

The front edge of the club head is formed having a second ball striking surface 32 which is generally vertically disposed at the front of surface 28. Surface 32 is provided with an insert 34 which is shown as being generally rectangular and formed from an impact resistant material. The club head can be fabricated from any suitable material such as hardwood, ash, often being used in golf head construction or a suitable metal alloy such as aluminum giving due consideration to weight requirements. Preferably the golf head of the club of the present invention is constructed consistent with the size of the ball to be described hereafter. For example, the overall club head width is approximately three inches and the club head height approximately one inch and the club depth being approximately two inches.

Figure 3:
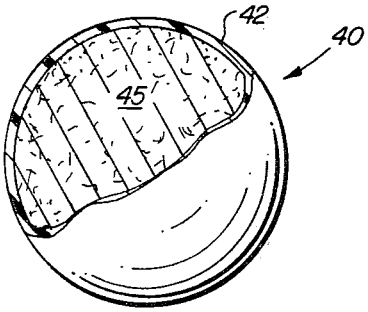
FIG. 3 is a view of a ball, partly broken away, used with the game of the present invention.

The ball for use with the golf game of the present invention is best illustrated in FIG. 3 and is generally designated by the numeral 40. Ball 40 has an outer cover or shell 42 of vinyl or some other impact and scuff-resistent material such as naugahyde. The ball can be molded or otherwise formed as provided with an inner core of resilient material 45 as for example a low density sponge rubber or low density expanded foam such as polyurethane. Typically, the ball will have a diameter of approximately three and one-half inches and should weigh approximately one and one-half ounces. The ball may be provided with a smooth outer surface or in some cases for greater stability may be "dimpled". The overall weight of the ball should not exceed 3½ ounces.

Figure 4:
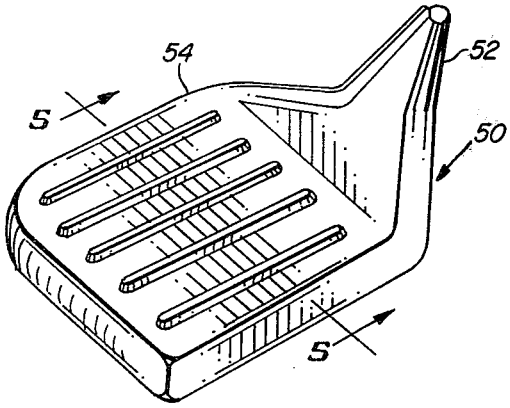
FIG. 4 is a perspective view illustrating an alternate embodiment of the club head.
Figure 5:
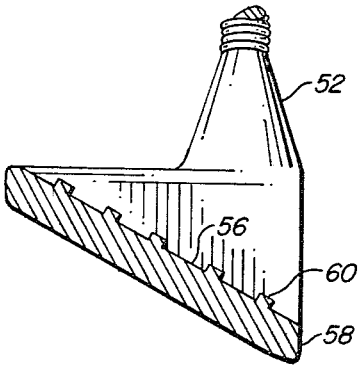
FIG. 5 is a sectional view taken along lines 5—5 of FIG. 4.

An alternate club head is shown in FIGS. 4 and 5. This club is generally designated by the numeral 50 and again includes a neck portion 52 which secures the club head 54 to a shaft and grip, not shown. The club head of this embodiment is provided with a blade surface 56 which is generally inclined from the front striking surface 58 rearwardly. The angle of inclination may vary but preferably is in a range from approximately 20° to 45°. A series of transversely extending ridges 60 are provided on the blade surface 56 to grip the ball and give the ball a desired back spin. As will be more fully evident hereafter, the blade surface 56 is used for striking the ball to achieve the desired degree of loft while the vertical face 58 are used for driving and putting the ball.

Figure 12:
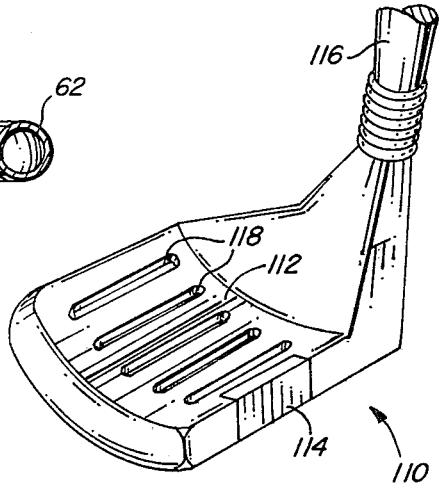
FIG. 12 is a perspective view of an alternate form of club.

FIG. 12 also shows another dual faced club represented by the numeral 110 having a blade surface 112 which is curved as shown. The front edge of surface 112 joins the driving and putting surface 114. Club 110 is provided with a shaft 116 and grip, not shown. Surface 112 is provided with transverse grooves 118 to impart spin to the ball when struck. Club 110 is generally similar to the club shown in FIGS. 1 and 2 except that the blade surface 112 is not transversely curved or dished.

Figure 6:
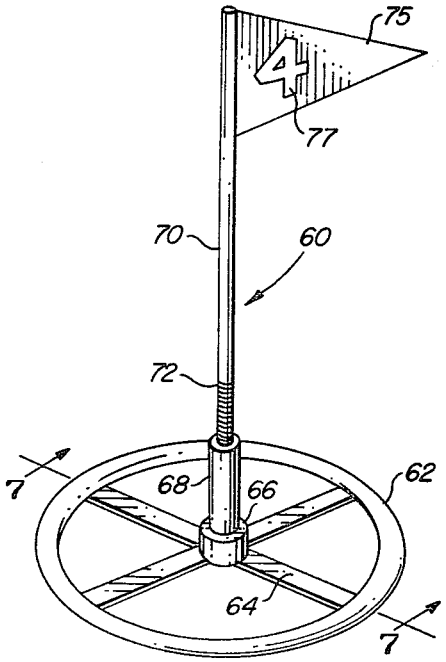
FIG. 6 is a perspective view of the target cup and flag used with the game of the present invention.
Figure 7:
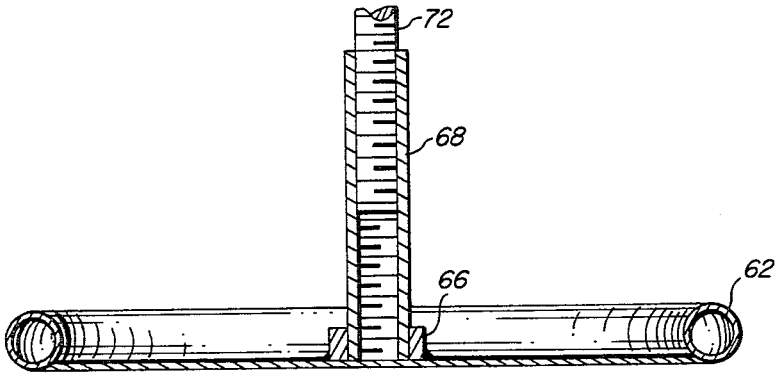
FIG. 7 is a sectional view taken along lines 7—7 of FIG. 6.

In FIGS. 6 and 7 the target cup used with the present invention is shown and is generally designated by the numeral 60. Target cup 60 includes a base ring 62 supporting a pair of cross braces 64 which intersect at hub 66. Hub 66 carries a stub shaft portion 68 which is internally threaded to receive pin 70 which has a lower threaded section 72 which is engageable in stub shaft 68. The upper end of pin 70 carries a flag 75 designated with the appropriate indicia 77 indicating the appropriate number of the hole. Ring 62 is of sufficient diameter to provide support for the pin and the area within the or defined by the inner diameter of ring 62 provides the target "cup" and the object of the game is for the golfer to place the ball 40 within the ring 62 on each hole in as few strokes as possible.

Figure 8:
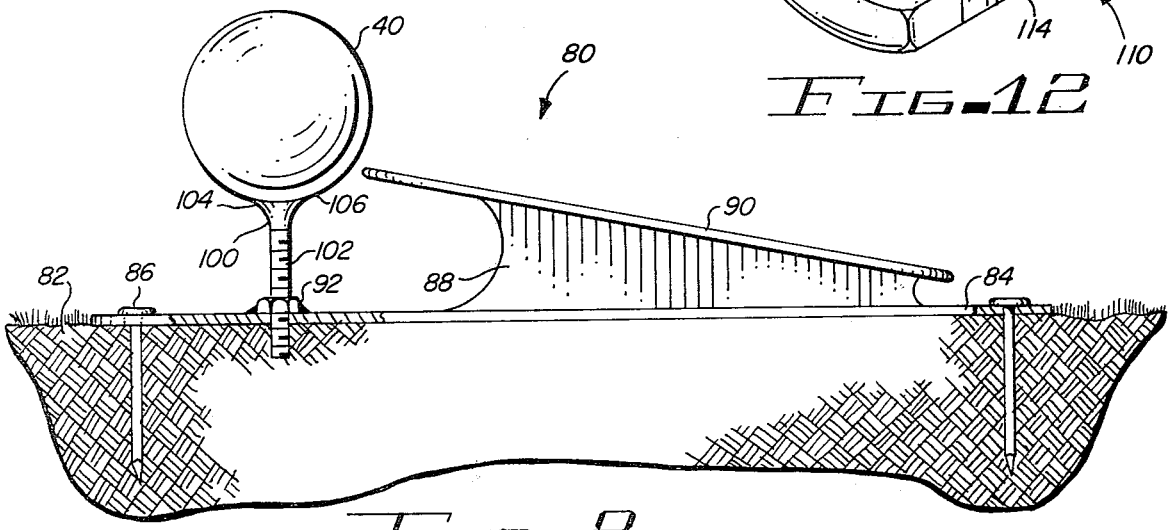
FIG. 8 is a side view of the tee construction with a ball placed on the tee.
Figure 9:
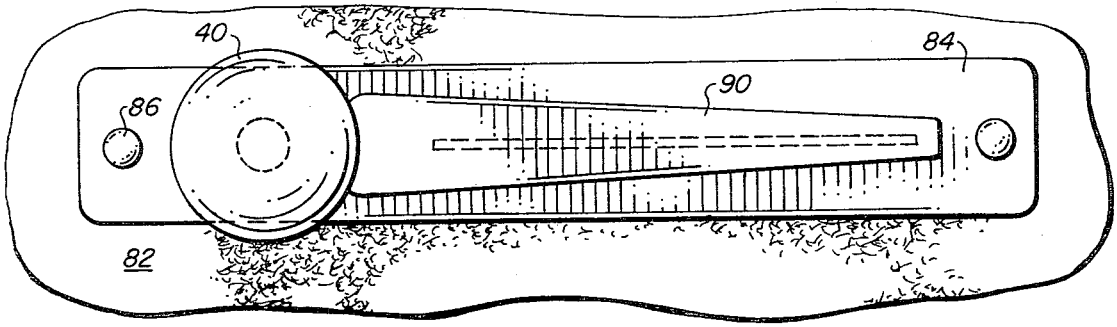
FIG. 9 is a top view of the ball and tee.

Since the ball and club of the present invention are of a special design, it is desirable to provide a tee box adapted to aid the golfer in hitting a properly elevated shot from the tee. The tee box is shown in FIGS. 8 and 9 and is generally designated by the numeral 80. Tee box 80 is adapted to be placed in the ground 82 at a suitable location on the golf course. The tee box 80 includes a base plate 84 which is securable in ground 82 by downwardly depending ground pins 86. Pins 86 may be removed if it is desired to relocate the tee box or for purposes of ground maintenance. Tee box plate 84 is provided with a perpendicular flange 88 which supports an inclined ramp section 90. At the forward end of ramp 90 a threaded collar 92 is provided on base plate 84. A tee 100 has a shank portion 102 which is provided with threads which are engageable in collar 92. By rotating shank 102, the elevation of the cup portion 104 of the tee may be varied. Cup portion 104 is provided with a concave upper surface 106 which conforms to the curvature of ball 40 so the ball may be conveniently rested on tee 100. The golfer standing along side the tee box 90 swings the club so the club follows a path generally defined by the upper surface of the ramp 90 so that the ball is struck at a location to elevate the drive.

An understanding of the present invention will become readily apparent from the following description of the technique involved in playing the game.

Figure 10A:
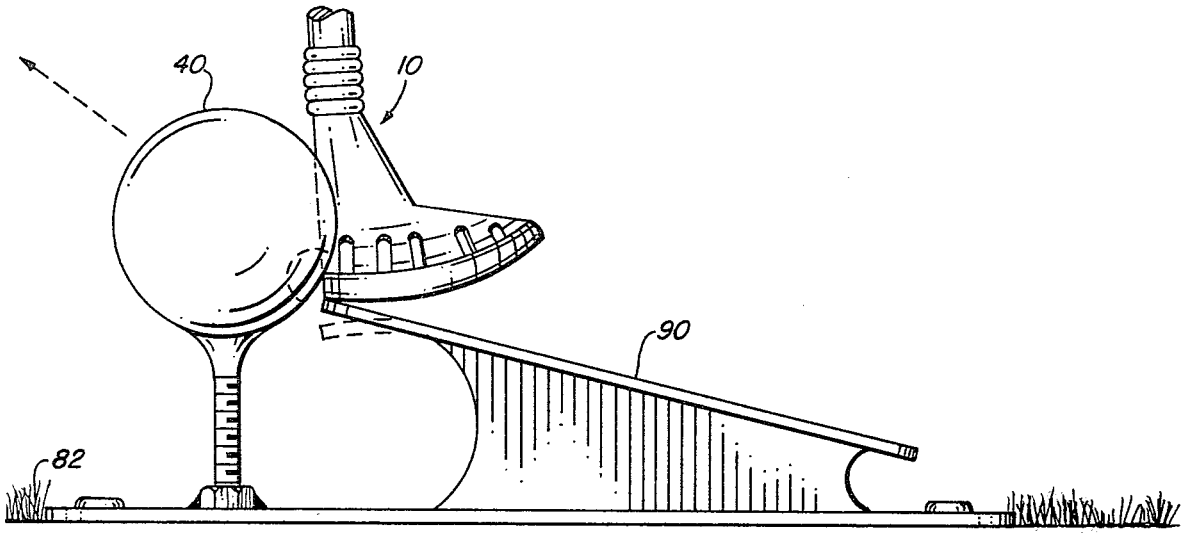
FIGS. 10A to 10C illustrates the different ways of striking the golf ball to achieve various lofts and trajectories using the club and ball of the present invention.
Figure 11:
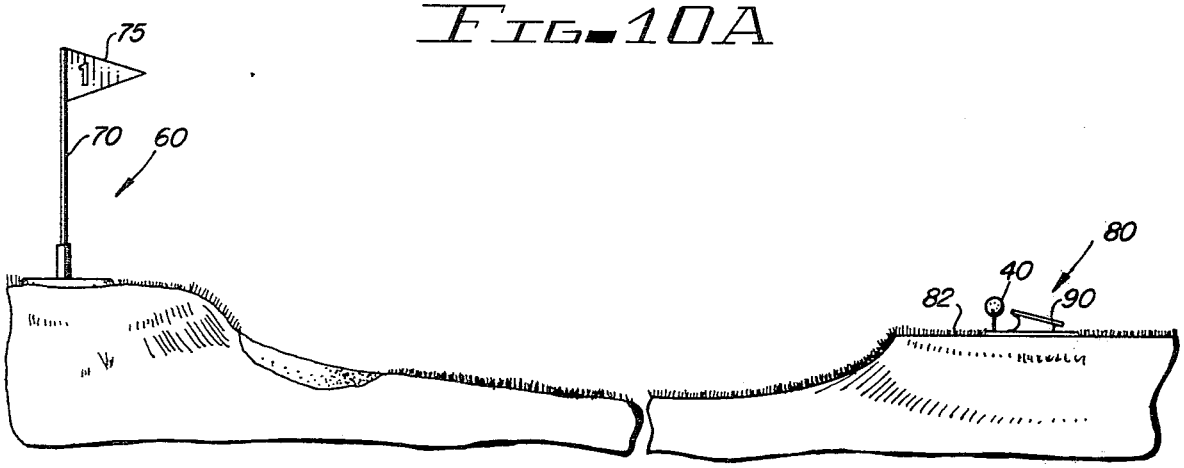
FIG. 11 is an elevational view of a typical golf hole according to the present invention.
Figure 10B:
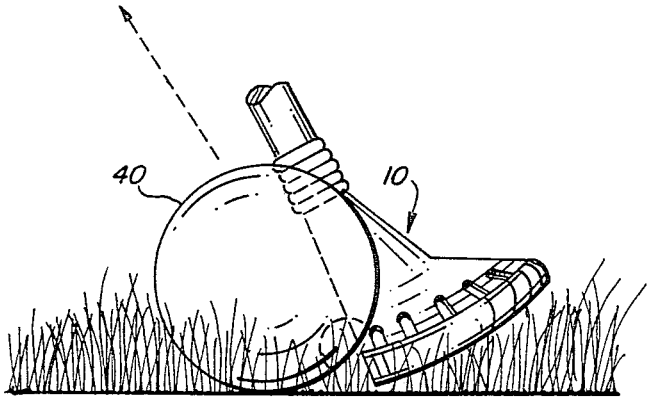
Figure 10C:
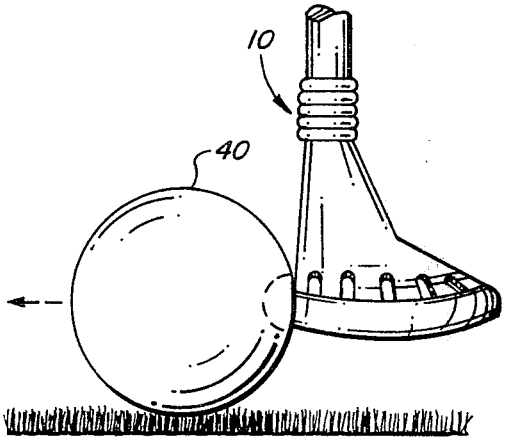

FIGS. 10A to 10C illustrate the three primary types of shots played in accordance with the present invention. The golf course for playing the game of the present invention will be laid out and generally can be accomodated on twenty-five hundred yards or less. Preferably, eighteen holes are within this area, with the holes having varying yardage. The fairways may average from fifty to two hundred yards. The course will be arranged in the normal manner with tee boxes, obstacles and hazards of various types such as sandtraps, trees and water as seen in FIG. 11. The green areas can be selected and the target pin 70 placed in a desired location. It is not necessary for the golf course to be used with the game of the present invention to have elaborately manicured green areas since the ball of the present invention is not as sensitive to ground variations and undulations. Further, since the target is portable, it may be easily moved about to vary the course layout from time to time so the same course can provide a variety of challenges even for the player who plays the course over and over. It will be appreciated that a cup of conventional design and of enlarged diameter can also be used in lieu of target 70. Ground maintenance is also facilitated since the greens do not have to be carefully attended and the equipment such as the tee box and target pin can be removed for mowing and the like.

Once the course is established, the player can begin at the number 1 tee box placing the ball 40 on the upper concave cup 106 as shown in FIGS. 8 and 9. A golfer would address the ball taking the proper stance and swing the golf club 10 in conventional manner striking the ball as shown in FIG. 11A. The ramp 90 helps to guide the club in a manner so the ball is struck at a location below the horizontal equator of the ball which tends to elevate the ball. The ball is struck with the front surface 32 and the ball is propelled a distance, as for example, 50 to 80 yards down the fairway.

The golfer then advances to the location of the ball and if it is within an appropriate distance of the target pin 60 as for example within about fifteen to fifty yards, the ball would be struck as a fairway pitch or chip shot, as best illustrated in FIG. 10B. Again the ball is struck at a location below the horizontal equator of the ball but with the curved or inclined blade surface 22. Some skill and practice is required as the golfer must strike the ball at a location along the blade 28 to give the required distance and elevation along with the back spin required to stop the ball. The ridges or grooves in the club blade surface help in this respect. It will be obvious that if the ball is struck along the blade surface near the front face, the shot will be a lower elevation and trajectory and travel a farther distance. If the ball is struck toward the rear of the club, the ball will travel at a higher arch or loft and less distance.

Once the player has advanced the ball to the green area, the club is used as a putter and the ball is rolled along the ground by striking the ball with the face 32 of the club 10.

The alternate type of club as shown in FIGS. 4, 5 and 12 may be also used and the clubs 50 and 110 are used in the manner described above with reference to club 10. Once the ball has been rolled over the hoop 62 of the target pin 60, the player counts the strokes he has taken to advance the ball from the tee and registers this score for the particular hole. The player then advances to the next hole and completes 18 holes totaling the score for the round of golf.

From the foregoing, it will be seen that the present invention provides a unique golf game which may be played in a reduced area with a single club but which closely simulates the "feel" and requires the same skills and techniques as regulation golf. The game may be enjoyed by players of all ages in substantially less time than conventional golf requires. Further, the game of the present invention lends itself to construction and establishment of a golf course at a considerably less expense as compared with regulation courses. The golf club and ball of the present invention can be used also as a practice tool for regulation golf in that the golfer can practice hitting within areas at parks and other location.

Another feature of the invention is that the club, ball and target can be provided as a set for home use either as a practice device or a game for children and adults.

It will be obvious to those skilled in the art to make various changes, alterations and modifications to the golf game and equipment described herein. To the extent that these changes, alterations and modifications do not depart from the spirit and scope of the appended claims, they are intended to be encompassed therein.

I claim:

1. A golf club for use with a golf ball having a diameter substantially greater than a conventional golf ball to provide the player a variety of shots including driving, putting and chipping, said club comprising:

(a) a shaft with a grip area at one end;

(b) a head having an upper and lower surface, said head being secured to the other end of said shaft and including:

(i) a first ball striking surface at the forward edge of said club head, said first striking surface being generally vertical and extending between the said upper and lower surfaces for driving and putting the ball; and (ii) a second ball striking surface, said second ball striking surface extending from the upper edge of the first striking area rearwardly and upwardly being arcuate in at least one dimension and further defining a plurality of transverse extending spaced-apart areas for impárting backspin to the ball and for achieving a lofted trajectory on the struck ball.

2. A game closely simulating the game of regulation golf to be played in a limited area and providing a variety of shots including driving, putting and chipping, said game to be played with the following:

(a) a ball having a diameter substantially greater than a conventional golf ball with a low density core and an outer covering; and (b) a golf club comprising:

(i) a shaft with a grip area at one end; and (ii) a head having an upper and lower surface, said head being secured to the other end of said shaft and including:

(A) a first ball striking surface at the forward edge of said club head, said first striking surface being generally vertical and extending between the upper and lower surface for driving and putting the said ball; and (B) a second ball striking surface, said second ball striking surface extending from the upper edge of the first striking area rearwardly and upwardly being arcuate in at least one dimension and further defining a plurality of transverse extending spaced-apart areas for imparting backspin to the ball and for achieving lofted shots.

3. The golf game of claim 2 further including golf target means comprising a generally circular base defining a target area, brace means on said base supporting an upstanding pin carrying indicia means for identifying the specific hole.

4. The golf game of claim 2 further including a tee means having a base plate and upstanding flange, angular ramp means carried on said flange, a golf tee at the forward end of said flange whereby the flange assists the golfer in obtaining the proper arc on the swing and impacting the ball at a location generally below the horizontal equator of the ball.

5. The golf game of claim 4 further including a ball having an approximate diameter of three and one-half inches and a weight of one and one-half ounces with a durable scuff-resistant outer shell.

6. The golf game of claim 5 wherein said golf tee is vertically adjustable with respect to said base plate.

* * * * *